US007447458B2

(12) United States Patent
Yoshida et al.

(10) Patent No.: US 7,447,458 B2
(45) Date of Patent: Nov. 4, 2008

(54) OPERATION PANEL AND IMAGE FORMING APPARATUS

(75) Inventors: Kenzo Yoshida, Ikoma (JP); Fumikazu Shimanuki, Nara (JP); Yukio Kanaoka, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 35 days.

(21) Appl. No.: 11/301,957

(22) Filed: Dec. 13, 2005

(65) Prior Publication Data

US 2006/0133840 A1 Jun. 22, 2006

(30) Foreign Application Priority Data

Dec. 20, 2004 (JP) ..... 2004-368429

(51) Int. Cl.
*G03G 21/00* (2006.01)

(52) U.S. Cl. ..... 399/81

(58) Field of Classification Search ..... 399/81
See application file for complete search history.

(56) References Cited

U.S. PATENT DOCUMENTS

2004/0062579 A1* 4/2004 Iwago et al. ..... 399/367
2004/0062583 A1* 4/2004 Kameyama et al. ..... 399/405
2004/0069600 A1* 4/2004 Xie ..... 200/5 R
2004/0090422 A1* 5/2004 Tsai ..... 345/168
2004/0247337 A1* 12/2004 Ohama et al. ..... 399/107

FOREIGN PATENT DOCUMENTS

| | | | |
|---|---|---|---|
| JP | 04240491 A | * | 8/1992 |
| JP | 06-054039 | | 2/1994 |
| JP | 2001-142609 | | 5/2001 |
| JP | 2003-316211 | | 11/2003 |
| JP | 2004-179001 | | 6/2004 |
| JP | 2004-311049 | | 11/2004 |
| JP | 2004-314348 | | 11/2004 |
| JP | 2004314348 A | * | 11/2004 |
| JP | 2006159303 A | * | 6/2006 |
| JP | 2006243812 A | * | 9/2006 |

OTHER PUBLICATIONS

Computer Translation for JP2004-314348a.*

* cited by examiner

*Primary Examiner*—Quana M Grainger
(74) *Attorney, Agent, or Firm*—Renner, Otto, Boisselle & Sklar, LLP

(57) ABSTRACT

An operation panel includes a panel surface, a key mounting surface, and a key. The panel surface is exposed to outside of a main apparatus. The key mounting surface is recessed by a predetermined length from the panel surface. The key is mounted on the key mounting surface to protrude beyond the key mounting surface by a length shorter than the predetermined length and configured to set the main apparatus to perform a predetermined operation based on a function previously assigned thereto when depressed.

3 Claims, 4 Drawing Sheets

OPERATION PANEL AND IMAGE FORMING APPARATUS

CROSS REFERENCE

This Nonprovisional application claims priority under 35 U.S.C. § 119(a) on Patent Application No. 2004-368429 filed in Japan on Dec. 20, 2004, the entire contents of which are hereby incorporated by reference.

BACKGROUND OF THE INVENTION

The present invention relates to an operation panel having keys each assigned a function related to an operation of an associated apparatus as well as an image forming apparatus provided with such an operation panel. Particularly, the invention relates to the art of improving the safety and operability for visually handicapped persons operating such an image forming apparatus.

In recent years, social activities of visually handicapped persons have been expanding increasingly. For this reason, it has been requested that the operability of apparatus in general be improved in order to allow visually handicapped persons (including weak-eyed persons and totally blind persons) to operate such apparatus safely and easily (refer to Section 508 of U.S. Rehabilitation Act for example).

Presently, makers of apparatus are selling manufactured products improved in safety and operability for visually handicapped persons according to their respective own standards that are each claimed as universal design by such a maker.

As disclosed in Japanese Patent Laid-Open Publication No. 2003-316211 for example, such a technique is applied to operation panels of copying machines or multifunctional machines as to make distinct the position and edges of each key by imparting the key top edges of each key with an acute angle and making the key top project from the surface of the operation panel. This technique allows visually handicapped persons to recognize the boundary between each key and the operation panel clearly.

In operating an operation panel, such a visually handicapped person touches the operation panel entirely by hand to recognize the key positions and the functions of respective keys and then operates a key assigned a desired function. Therefore, it does not mean that the operability of the operation panel employing the aforementioned technique is improved, even though the positions of keys are distinct.

Also, with the keys having respective key tops positioned above the panel surface, a problem arises that operation errors and the like are likely on the contrary. For example, in copying a large-sized document, such as a book or newspaper, by a copying machine having an operation panel with its top surface positioned at substantially the same height level as the upper surface of a platen, a part of the document that extends off the platen in placing the document on the platen may touch any one of the keys on the operation panel. In such a case, it is highly possible that a key associated with a function that is unwanted by a visually handicapped person as the operator is depressed by such a part of the document. This may result in an undesirable change in the settings of the copying machine or wasteful copying.

Further, care should be taken not to give the operation panel a complicated outward appearance or impart non-handicapped persons with a sense of incongruity during operation due to too much importance attached only to the safety and operability for visually handicapped persons.

A feature of the present invention is to provide an operation panel which has an improved vertical positional relation between the key top of a key associated with an important function for operating a main apparatus and the surface of the operation panel, which does not seem to have a complicated outward appearance or impart non-handicapped persons with a sense of incongruity during operation, which is capable of protecting a visually handicapped person operating the operation panel from injury on a hand or finger and avoiding setting errors and malfunctions, and which can offer improved safety and operability.

SUMMARY OF THE INVENTION

An operation panel according to the present invention includes a panel surface, a key mounting surface, and a key. The panel surface is exposed to outside of a main apparatus. The key mounting surface is recessed by a predetermined length from the panel surface. The key is mounted on the key mounting surface to protrude beyond the key mounting surface by a length shorter than the predetermined length and configured to set the main apparatus to perform a predetermined operation based on a function previously assigned thereto when depressed.

According to the present invention, the key is a mode setting key or a start key. The mode setting key is assigned a function of specifying an operation mode for image formation. The start key is assigned a function of instructing the main apparatus to start an image forming operation.

The foregoing and other features and attendant advantages of the present invention will become more apparent from the reading of the following detailed description of the invention in conjunction with the accompanying drawings.

DETAILED DESCRIPTION OF THE PREFERRED EMBODIMENTS

Figure 1:
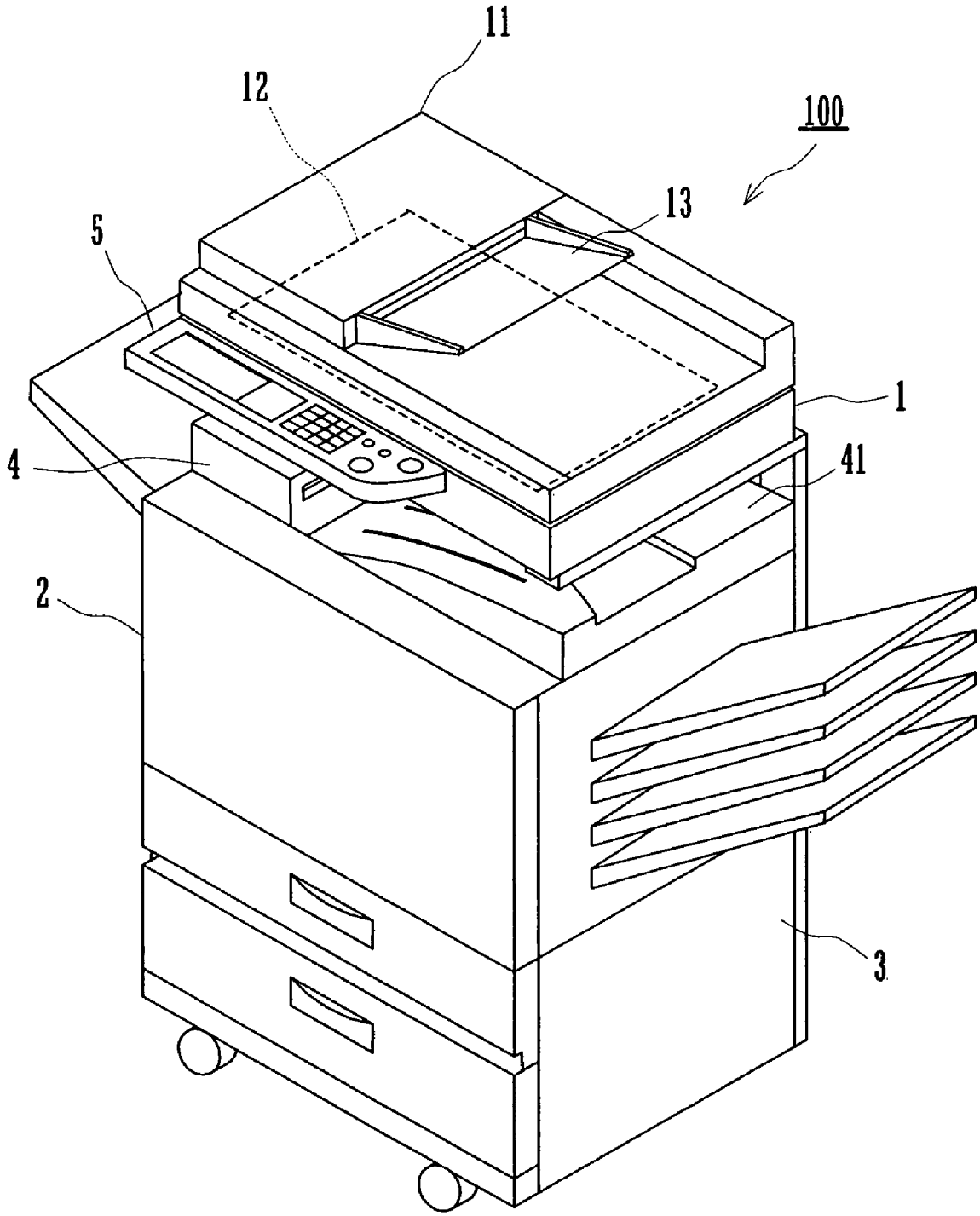
FIG. 1 is a schematic view showing the construction of an image forming apparatus employing an operation panel according to an embodiment of the present invention.

Hereinafter, an operation panel and an image forming apparatus according to the present invention will be described in detail with reference to the accompanying drawings. FIG. 1 is a schematic view showing the construction of an image forming apparatus employing an operation panel according to an embodiment of the present invention. The image forming apparatus 100 includes a scanner section 1, an image forming section 2, a sheet feed section 3, and a delivery section 4.

The scanner section 1 is provided on its top with an automatic document feeder (hereinafter will be referred to as "ADF") 11. The ADF 11 is pivotally hinged on the rear side thereof to cover and expose the upper surface of a platen 12 forming the top surface of the scanner section 1. The ADF 11 feeds document sheets set on a document tray 13 one by one to the platen 12. The scanner section 1 reads image information from a document sheet placed on the platen 12.

The image forming section 2 forms an image on a recording sheet fed from the sheet feed section 3 in accordance with image data prepared based on the image data read by the scanner section 1. The recording sheet finished with image formation is received on a delivered sheet tray 41 in the delivery section 4.

The operation panel 5 protrudes from the front side of the scanner section 1. The operation panel 5 has an upper surface forming a panel surface which is substantially flush with the upper surface of the platen 12.

Figure 2:
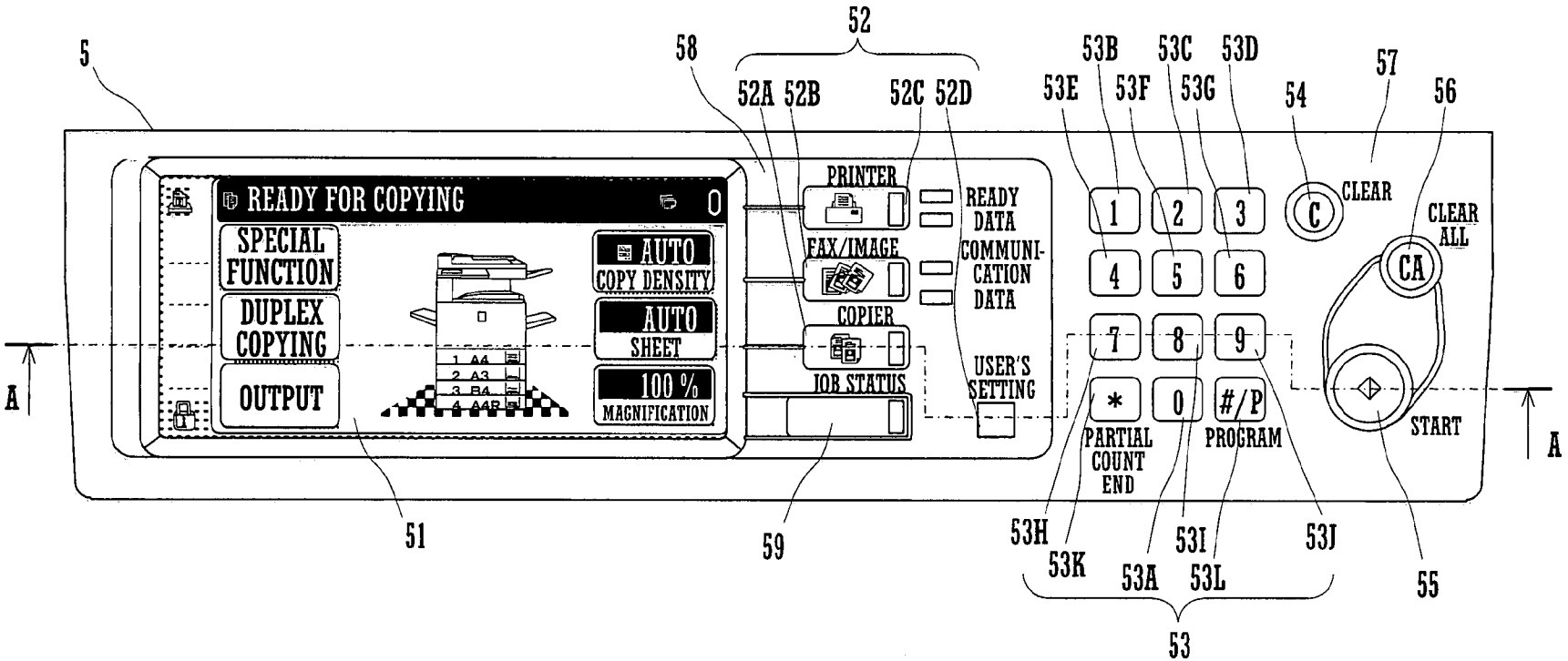
FIG. 2 is a plan view of the operation panel used in the image forming apparatus.
Figure 3:
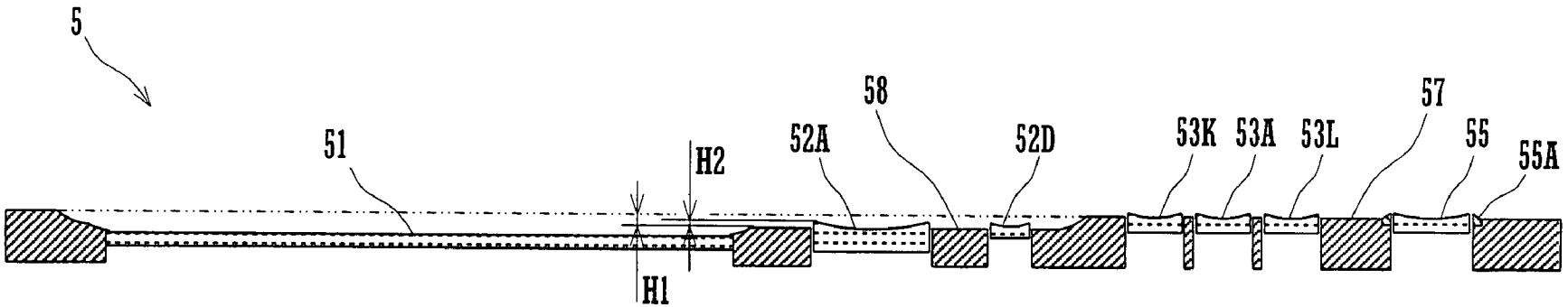
FIG. 3 is a sectional view taken on line A-A of FIG. 2.

FIG. 2 is a plan view of the operation panel used in the image forming apparatus; and FIG. 3 is a sectional view taken on line A-A of FIG. 2. The operation panel 5 includes a display 51, mode setting keys 52, a numeric key pad 53, a clear key 54, a start key 55, a clear all key 56, and a job status key 59.

The display 51 displays the status of operation of the image forming apparatus 100 and operating conditions established of the apparatus 100. The mode setting keys 52 include a copier mode key 52A, a facsimile/image transmission mode key 52B, a printer mode key 52C, and a user's setting key 52D.

The copier mode key 52A is assigned the function of setting the image forming apparatus 100 to perform an image forming operation based on the image information read by the scanner section 1. The facsimile/image transmission mode key 52B is assigned the function of setting the image forming apparatus 100 to perform transmission of the image information read by the scanner section 1 to an external device such as a facsimile apparatus. The printer mode key 52C is assigned the function of setting the image forming apparatus 100 to perform an image forming operation based on image data inputted from an external device. The user's setting key 52D is assigned the function of setting the image forming apparatus 100 to store various operating conditions for image forming operation in combination.

The numeric keypad 53 comprises "0" to "9" numeric keys 53A to 53J, an asterisk key 53K, and a program key 53L. The clear key 54 is assigned the function of clearing a numeral set by the numeric keypad operated. The start key 55 is assigned the function of instructing the image forming apparatus 100 to start the image forming operation. The clear all key 56 is assigned the function of initializing all image forming conditions.

In the operation panel 5 according to this embodiment, a key mounting surface 58 is recessed by a predetermined length H1 from the panel surface 57 which is substantially flush with the upper surface of the platen 12. On the key mounting surface 58 are mounted the mode setting keys 52 and the job status key 59 together with the display 51. On the other hand, the numeric keypad 53, clear key 54, start key 55 and clear all key 56 are mounted on the panel surface 57.

As can seen from the copier mode key 52A shown in FIG. 3, each of the mode setting keys 52 has a height H2 from the key mounting surface 58 to the key top which is shorter than the predetermined length H1 which is the difference in height between the panel surface 57 and the key mounting surface 58. Accordingly, the key top of each mode setting key 52 does not protrude upwardly beyond the panel surface 57.

Actually, the height H2 of each mode setting key 52 from the key mounting surface 58 to the key top is made equal to the corresponding height of any one of the keys that are mounted on the panel surface 57 including the numeric keypad 53, while the length H1 is made longer than the height H2.

For this reason, in copying a part of a document having a large area such as a book or newspaper for example by placing the part on the platen 12, even if a part of the document extends off the platen 12 to a position above the operation panel 5, the document touches the panel surface 57 without directly touching any mode setting key 52. Thus, switching to an undesired mode is not possible without the operator becoming aware of that and, hence, an undesired operation due to a mode setting error is not performed.

Further, since the key mounting surface 58 is merely recessed from the panel surface 57, the operation panel 5 does not substantially differ in plan view whether or not the key mounting surface 58 is provided. For this reason, the operation panel 5 does not seem to have any complicated outward appearance. Moreover, it is not possible that the operator is imparted with a sense of incongruity during operation because the height H2 is made equal to the corresponding height of any one of the keys that are mounted on the panel surface 57.

The start key 55 is provided with a rib 55A therearound as shown in FIG. 3. For this reason, even if a part of the document extends off the platen 12 to a position above the operation panel 5, the start key 55 cannot be depressed by that part of the document and, hence, the image forming operation is not started at any operator's undesired time. This holds true for the clear key 54 and the clear all key 56.

Since such a key as the start key 55 is assigned the function of setting the image forming apparatus 100 to perform an important operation like the mode setting keys 52, the provision of the rib 55A can prevent an erroneous operation on such a key which is likely to affect the conditions of image formation immediately.

The rib 55A may be eliminated if a highly important key such as the start key 55 is mounted on the key mounting surface which is recessed by the predetermined length H1 from the panel surface 57.

Each of the numeric keys of numeric keypad 53 is not provided with a rib. However, if the numeric keypad 53 is configured to generate an operating sound upon operation on each numeric key in order to allow the operator to recognize the operation on the numeric keypad 53 by hearing, even a visually handicapped person can be aware of the fact that the numeric keypad 53 has been operated by, for example, a part of the document extending off the platen 12. With such a configuration, the operator can input a correct numeric value again by operating a numeric key corresponding to the numeric value after operation on the clear key 54.

Figure 4:
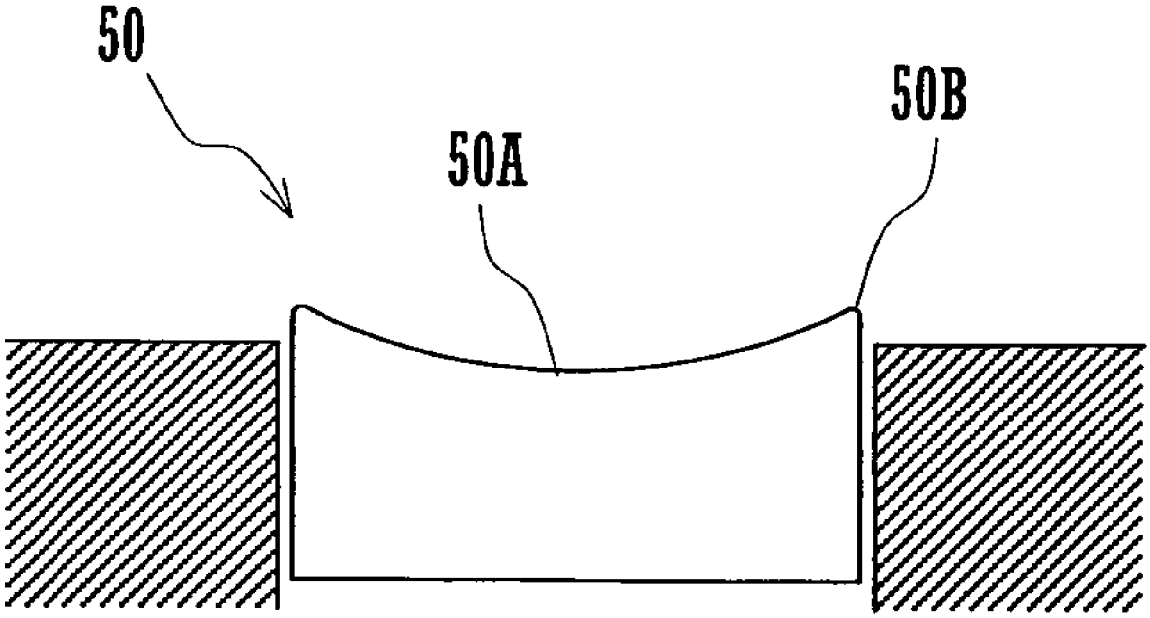
FIG. 4 is a sectional side elevational view of a key mounted on the operation panel of the image forming apparatus.

If each key 50 has a concaved key top 50A and rounded angular portions 55B as shown in FIG. 4, a visually handicapped person can be protected from injury on his or her hand or finger.

If the key mounting surface 58 of the operation panel 5 has a relatively large area, the key mounting surface 58 is provided thereon with a crosspiece having an upper surface flush with the panel surface 57. Even when a part of a document that is relatively narrow in the transverse direction extends off the platen 12, the provision of such a crosspiece makes it possible to prevent any key on the key mounting surface 58 from being operated by that part of the document.

The foregoing embodiments are illustrative in all points and should not be construed to limit the present invention. The scope of the present invention is defined not by the foregoing embodiment but by the following claims. Further, the scope of the present invention is intended to include all modifications with in the meanings and scopes of claims and equivalents.

What is claimed is:

1. An image forming apparatus comprising:

a platen having an upper surface for a document to be placed thereon;

an image forming section forming an image on a recording sheet in accordance with an image data read from the document placed on the platen; and an operation panel including:

a panel surface exposed to outside of an apparatus body and substantially flush with the upper surface of the platen;

a key mounting surface mounted at a side closer to a first end of the panel surface and recessed by a predetermined length from the panel surface; and a first key mounted on the key mounting surface to protrude beyond the key mounting surface by a length shorter than the predetermined length and configured to set the apparatus body to perform a predetermined operation based on a function previously assigned thereto when depressed, wherein said operation panel includes plural second keys, the second keys being mounted to a position which does not include said key mounting surface of said panel surface and is at a side closer to a second end of the panel surface than said key mounting surface, a protrusion length of said first key from said key mounting surface being equal to that of said second keys from said panel surface, and a key closer to a side of the second end of the panel surface, of said second keys, being provided with a rib protruded a predetermined length from the panel surface therearound.

2. The image forming apparatus according to claim 1, wherein said first key is a mode setting key assigned a function of specifying an operation mode for image formation.

3. The image forming apparatus according to claim 1, wherein the key closer to the side of the second end of the panel surface, of said plural second keys, is a start key assigned a function of instructing the apparatus body to start an image forming operation.

* * * * *